US005743329A

United States Patent [19]

Damsohn et al.

[11] Patent Number: 5,743,329

[45] Date of Patent: Apr. 28, 1998

[54] HEAT EXCHANGER HAVING A COLLECTING PIPE WITH A SLOT FORMED THEREIN

[75] Inventors: Herbert Damsohn, Aichwald; Wolfgang Gerlach, Schönaich; Walter Wolf, Oppenweiler-Zell, all of Germany

[73] Assignee: Behr GmbH & Co., Stuttgart, Germany

[21] Appl. No.: 561,331

[22] Filed: Nov. 21, 1995

[30] Foreign Application Priority Data

Nov. 25, 1994 [DE] Germany ..... 44 42 040.4

[51] Int. Cl.[6] ..... F28F 9/02

[52] U.S. Cl. ..... 165/174; 165/153; 165/173

[58] Field of Search ..... 165/151, 153, 165/173–176; 29/890.052

[56] References Cited

U.S. PATENT DOCUMENTS

| | | | |
|---|---|---|---|
| 3,689,972 | 9/1972 | Mosier et al. . | |
| 4,945,635 | 8/1990 | Nobusue et al. . | |
| 4,960,169 | 10/1990 | Granetzke | 165/173 |
| 5,052,478 | 10/1991 | Nakajima et al. . | |
| 5,119,552 | 6/1992 | Sutou et al. . | |
| 5,209,292 | 5/1993 | Arneson et al. | 165/174 X |
| 5,236,044 | 8/1993 | Nagasaka et al. | 165/173 X |
| 5,243,842 | 9/1993 | Kobayashi et al. . | |
| 5,265,672 | 11/1993 | Aoki . | |
| 5,297,624 | 3/1994 | Haussmann et al. | 165/173 |
| 5,363,911 | 11/1994 | Velluet et al. | 165/173 |

FOREIGN PATENT DOCUMENTS

| | | |
|---|---|---|
| 0 548 850 | 6/1993 | European Pat. Off. . |
| 567398 | 10/1993 | European Pat. Off. . |
| 0 584 993 | 3/1994 | European Pat. Off. . |
| 593360 | 4/1994 | European Pat. Off. . |
| 4404928 | 9/1994 | Germany . |

OTHER PUBLICATIONS

Patent Abstracts of Japan vol. 16, No. 72, (M–12.13), Feb. 21, 1992, abstract of NIIMURA, "Preparation of Header Pipe For Heat Exchanger", Japanese 3–260594, Nov. 20, 1991.

Patent Abstracts of Japan vol. 16, No. 26, (M–1202), Jan. 22, 1992, abstract of SUDO, "Manufacture of Header Pipe For Heat Exchanger", Japanese 3–238130, Oct. 23, 1991.

Patent Abstracts of Japan vol. 16, No. 34, (M–1204), Jan. 28, 1992, abstract of SUDO, "Manufacture of Header Pipe For Heat Exchanger", Japanese 3–243233, Oct. 30, 1991.

*Primary Examiner*—Leonard R. Leo
*Attorney, Agent, or Firm*—Foley & Lardner

[57] ABSTRACT

A heat exchanger is disclosed which has a collecting pipe having formed therein at least one slot whereby the slot lies in a plane roughly perpendicular to the collecting pipe longitudinal axis. A flat pipe, which is capable of accommodating a fluid, a partition, or the like can be inserted into the slot, the narrow sides of the slot being limited by parallel-running slot walls of the collecting pipe which extend roughly along a tangent to a circle around the pipe longitudinal axis. The slot length, determined by the spacing between the slot walls, corresponds at least to the pipe inner diameter. A method of making a slot in a collecting pipe also is disclosed whereby in order to produce the smallest possible pipe diameter and high compressive strength, a stable and seal-tight connection of a laterally issuing structural part is ensured. To prepare such a slot, it is envisaged that the slot walls are formed by deformation of the material of the collecting pipe, which slot walls have a constant wall thickness over their wall length, the outer sides of the slot walls lying for the most part outside the pipe outer casing. A heat exchanger having a slot formed in a, collecting pipe, such as a condenser, a heating element, an oil cooler, a charge cooler or the like is disclosed.

7 Claims, 6 Drawing Sheets

HEAT EXCHANGER HAVING A COLLECTING PIPE WITH A SLOT FORMED THEREIN

BACKGROUND OF THE INVENTION

1. Field of the Invention

The invention relates to a heat exchanger having a collecting pipe which has a slot formed therein that can accept a flat pipe. The invention also relates to a process for creating a slot in a collecting pipe of this type.

2. Description of Related Art

U.S. Pat. No. 5,265,672 describes a heat exchanger having two parallel collecting pipes between which there are disposed flat pipes having fluid flowing therethrough. The flat pipes respectively open out into a slot in the collecting pipe, which slot is disposed in a plane roughly perpendicular to the longitudinal axis of the collecting pipe. For the delivery of heat, the heat-exchanger fluid flows through the flat pipes whereby the collecting pipes serve as a connection between two adjacent flat pipes. At the axial ends of the collecting pipes there are disposed holding rails of reinforced configuration, which are guided through the slots into the collecting pipes and, as a partition, axially seal the interior of the collecting pipe.

The slots are limited on their narrow sides by parallel-running slot walls of the collecting pipe, the slot walls extending roughly along a tangent to a circle around the pipe longitudinal axis. The slot length determined by the spacing between the slot walls corresponds to the inner diameter of the collecting pipe in order to ensure that a flat pipe or a sealing element, such as a partition, can be introduced into the slot without difficulty. The structural part which has been introduced is hereupon embraced over the length of the parallel-running slot walls on the narrow sides of the slot and can be fixedly connected to the collecting pipe, for example by soldering. The disclosure of U.S. Pat. No. 5,265,672 is hereby incorporated by reference in its entirety.

The connection described in the aforementioned U.S. patent has the drawback that the length of the slot wall which is present for a connection of the collecting pipe and the inserted structural part is very small, since this length is dependent upon the inner diameter and outer diameter of the collecting pipe. Furthermore, the length of the slot wall reaches maximally from a pipe center plane to the point of intersection of the slot wall with the outer casing of the collecting pipe. The connection of the collecting pipe and the intruding structural part must be realized within this limited slot wall length.

As the spacing from the pipe center plane increases, the slot walls become increasingly thin and adjoin, at a roughly acute angle, the outer casing of the collecting pipe. In the region of the outer casing, there is the danger that the slot walls will no longer show the necessary stability and the material may begin to crack upon application of even relatively small forces such as can be generated, for example, when a flat pipe is inserted into the slot. In the event of initial cracking, a seal-tight and pressure-resistant connection is not guaranteed, so that the entire collecting pipe has to be replaced.

SUMMARY OF THE INVENTION

It is therefore an object of the invention to provide a heat exchanger having a collecting pipe, with which, given the smallest possible diameter and high compressive strength, a stable and seal-tight connection of a laterally entering structural part is ensured. It is an additional object of the invention to provide a process by which it is possible to produce a collecting pipe for a heat exchanger of this type.

In accordance with these and other objectives readily apparent to those skilled in the art, there is provided a heat exchanger having a collecting pipe in which there is at least one slot lying in a plane roughly perpendicular to the longitudinal axis of the collecting pipe. A flat pipe, capable of passing fluid can be inserted into the slot, or a partition can be inserted. The narrow sides of the slot can be limited by parallel-running slot walls of the collecting pipe, which extend roughly along a tangent to a circle constructed around the collecting pipe longitudinal axis. The slot length, determined by the spacing between the slot walls, corresponds at least to the collecting pipe inner diameter, wherein the slot walls are formed from deformed wall portions of the collecting pipe, which have a constant wall thickness over their wall length. The outer sides of the slot walls lie for the most part outside the collecting pipe outer casing.

In accordance with an additional object of the present invention, there is provided a method of making a slot as described above in a collecting pipe of a heat exchanger which includes first making a slot of smaller slot length than the collecting pipe inner diameter by a cutting mechanism, and then enlarging and calibrating to the slot length the collecting pipe walls which limit the narrow sides of the slot by a slot punching means.

Since the slot walls are identical to the deformed walls of the collecting pipe, they have a constant wall thickness over their entire wall length. The slot walls therefore are of substantially more stable configuration than the prior art, and the danger of material failure is substanially reduced.

These and other objects of the present invention will be readily apparent upon review of the detailed description which follows.

DETAILED DESCRIPTION

Figure 1:
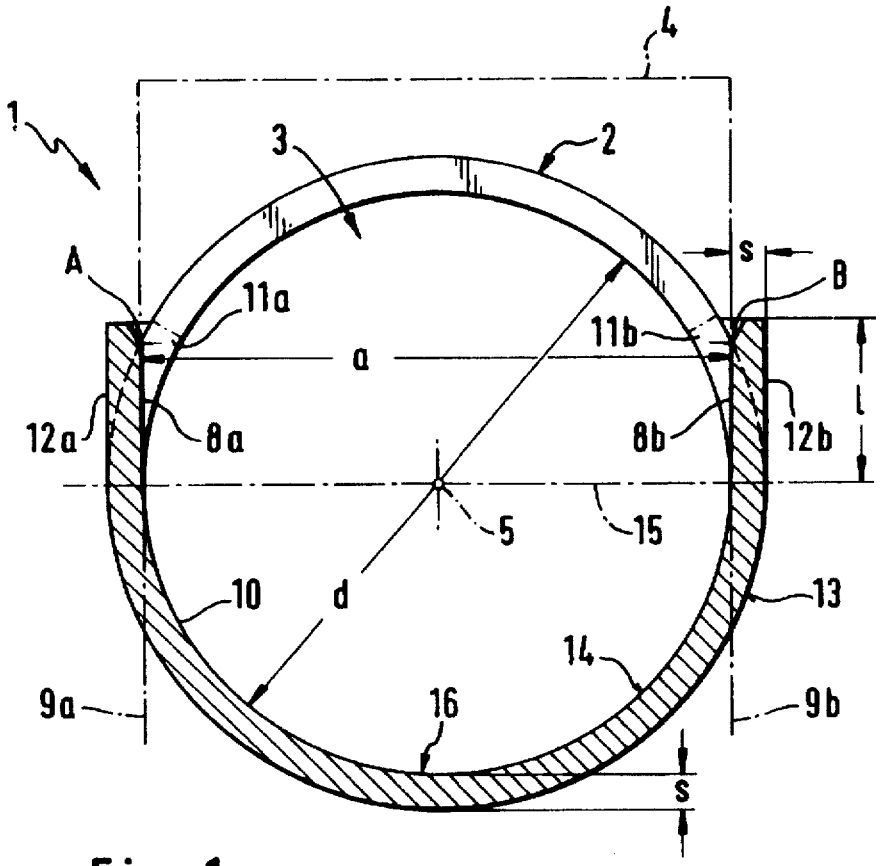
FIG. 1 illustrates a cross section through a collecting pipe along the slot plane having shaped slot walls.

A slot of the invention can be prepared by making a slot of smaller slot length than the inner diameter of the collecting pipe by using a cutting means. Throughout this description, cutting means denotes various cutting tools, for example a saw, a mill, a punch, or the like. The collecting pipe walls defining the slot having a smaller slot diameter than the length of the inner diameter of the collecting pipe then are enlarged and calibrated to the definitive slot length using a slot punching means. Throughout this description, slot punching means denotes any mechanism capable of deforming or punching out a particular shape in a collecting pipe. Slots of this type are fast and simple to produce from the production engineering aspect.

The widened slot walls expediently extend at least from a center plane through the collecting pipe to a point of intersection of the tangent to the slot wall with the outer casing of the collecting pipe. For this purpose, in a first step, a slot is made in the collecting pipe, the slot length of which is reduced relative to the inner diameter of the collecting pipe by at least double the wall thickness of the collecting pipe. This ensures that the structural part inserted in the slot is held over a minimum length on its narrow sides by the slot walls and, because of the larger connecting surface, the structural part is held positionally secure and a pressure-tight connection can be produced.

In an advantageous embodiment of the invention, a circumferential groove which forms the slot bottom can be configured on the inner casing of the collecting pipe in the region of the slot plane, the groove bottom of which has a larger spacing from the longitudinal axis than has the pipe inner casing. A flat pipe or partition can be inserted into this radially widened groove, whereby the radially widened groove has a larger width than the inner diameter of the collecting pipe. The widened groove can be produced using the slot punch, which is sunk into the pipe interior and forces the slot bottom radially outward. In this embodiment, the groove runs in a semicircle concentric to the inner casing of the collecting pipe; those end portions of the groove which adjoin the semicircle are advantageously formed by the slot walls.

In accordance with the invention, it is possible that the spacing of the groove bottom of the widened groove from the pipe inner casing in the direction of the slot bottom increasingly diminishes so that that side of the inner casing which is situated at maximum remoteness from the slot opening is not or is only slightly widened. In addition, the slot walls can be offset radially outward relative to the pipe inner casing so that a shoulder is formed between the slot walls and the pipe inner casing, thereby limiting the depth of insertion of the structural part to be introduced laterally into the collecting pipe.

The collecting pipe can have a cross section which differs from the circular form and which, in particular, is symmetrical relative to a cross-sectional longitudinal axis. The cross section expediently is formed from two circular segments of different radius, which are joined together by straight wall portions aligned roughly parallel to the cross-sectional longitudinal axis. The slot opening can be made on the circular segment of the larger radius, the slot walls extending on the straight wall portions. The depth of insertion typically is limited by that circular segment of smaller radius which lies opposite the slot opening.

Referring now to FIG. 1, there is a section transverse to the longitudinal axis 5 of a collecting pipe 2 which is produced in one piece and is inserted in a heat exchanger 1 (not shown). Collecting pipe 2 has a slot 3, which lies in a plane 4 roughly perpendicular to the longitudinal axis 5 of the collecting pipe. Over the axial length of the collecting pipe, a plurality of parallel-running slots usually are made, into which flat pipes can be inserted. Heat-exchanger fluid typically will flow through these flat pipes, whereby the heat-exchanger fluid of a flat pipe flows into the interior of the collecting pipe and is diverted into the adjacent flat pipe. In order to obtain a clear, meandering flow guidance through adjacent flat pipes, partitions can be inserted into further slots in the collecting pipe, which partitions tightly seal the collecting pipe cross section.

The narrow sides of the slot 3 are limited by parallel-running slot walls **8*a*, 8*b* of the collecting pipe 2, which extend roughly along a tangent 9*a*, 9*b* to a circle 10, lying in the pipe inner casing 14, around the pipe longitudinal axis 5. The slot length (a) can be determined by the spacing between the slot walls 8*a*, 8*b* and corresponds to the inner diameter (d) of the collecting pipe 2**.

The slot walls **8*a*, 8*b* usually are formed from the shaped walls 11*a*, 11*b* of the collecting pipe 2 and have a constant wall thickness (s) over their wall length (L). The outer sides 12*a*, 12*b* of the slot walls typically extend for the most part outside the outer casing 13 of the collecting pipe 2. A flat pipe of equal or smaller cross section to the cross section of the slot can be inserted in slot 3, the depth of insertion being limited by a pipe center plane 15 which runs between the semicircular slot bottom 16 and the adjoining slot walls 8*a*, 8*b*. If the pipe cross section is intended to be tightly sealed, a partition can be inserted into the slot, which partition bears against the inner casing 14** of the collecting pipe in the region of the slot. Flat pipes and partitions can be anchored firmly in the slot by soldering. Those skilled in the an are capable of anchoring flat pipes and partitions into the slots using conventional means in accordance with the guidelines provided herein.

With the configuration of the slot in the collecting pipe, it is possible that the outer diameter of the collecting pipe exceeds the slot length (a) by merely double the wall thickness (s). The wall thickness of the slot walls **8*a*, 8*b*, which in the illustrative embodiment according to FIG. 1** is identical to the wall thickness (s) of the collecting pipe, is constant over the entire length (L) of the slot walls; the slot walls, even in the region of their axially open ends, can therefore absorb high transverse stresses without any risk of material fracture. The risk of cracking when the slot walls are widened to their final measure (a) is also significantly reduced. In addition, the bursting pressure of a collecting pipe having such configuration can measure up to 120 bar and, where appropriate, even more.

Figure 2:
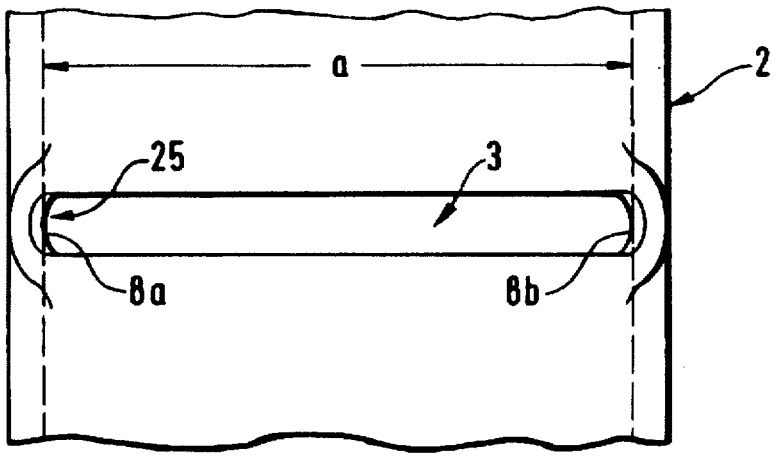
FIG. 2 illustrates a top view of the collecting pipe according to FIG. 1 in the region of the slot opening.

Referring now to FIG. 2, there is shown a top view of the collecting pipe 2 in the region of the slot 3. The slot walls **8*a*, 8*b* can be configured in a part-circular shape in the form of a slot groove 25, into which the correspondingly shaped flat pipe or the partition can be inserted. The slot groove 25 allows the structural part which is being inserted to be securely introduced along the slot plane 4, as illustrated in FIG. 1**.

Referring again to FIG. 1, it is advantageous if slot walls **8*a*, 8*b* extend at least from the pipe center plane 15 to a point of intersection A and B, respectively, of the tangents 9*a* and 9*b* with the outer casing 13 of the collecting pipe. This configuration ensures that the flat pipe or the partition is held over a minimum length in tile slot 3**.

Figure 3:
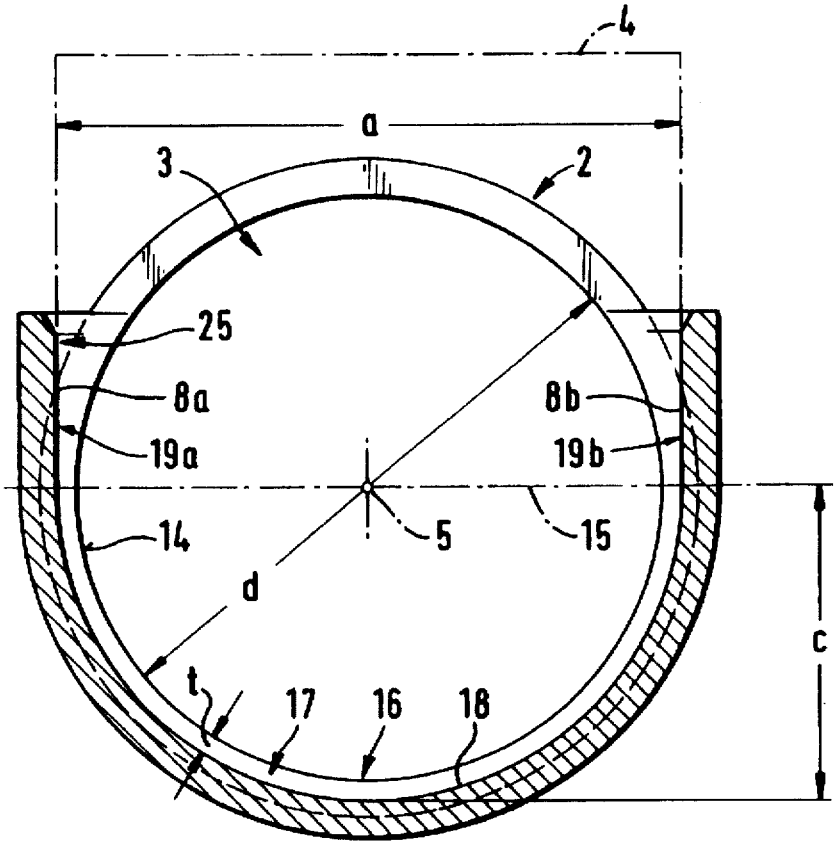
FIG. 3 illustrates a cross section through a collecting pipe having a circumferential, radially widened groove.
Figure 4:
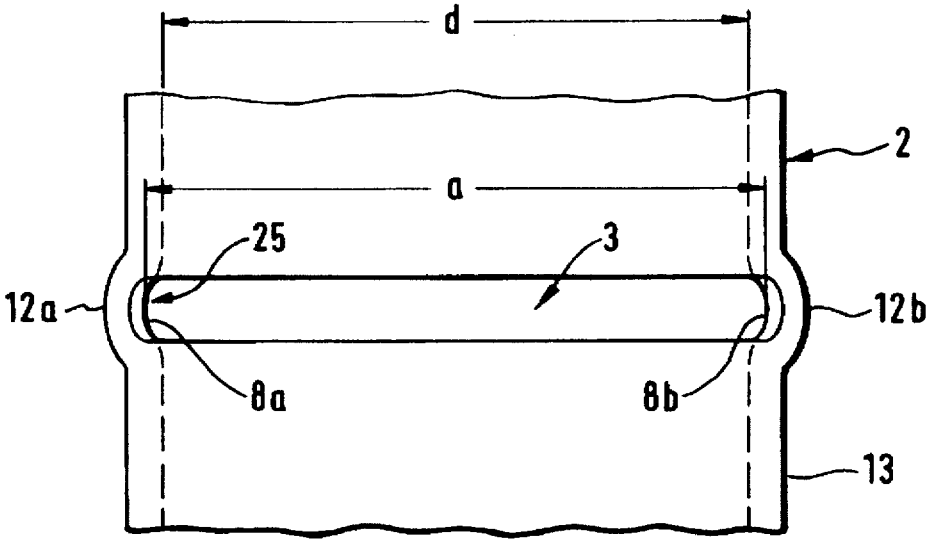
FIG. 4 illustrates a top view of the collecting pipe according to FIG. 3.

Referring now to FIGS. 3 and 4, there is shown a further advantageous design of the slot in the collecting pipe. On the inner casing 14 of the collecting pipe 2 there is configured, in the region of the slot plane 4, a circumferential groove 17 forming the slot bottom 16, the groove bottom 18 of which has a larger spacing (c) from the pipe longitudinal axis 5 than has the pipe inner casing 14. The groove bottom 18 forms a concentric circle to the inner casing 14 and is offset radially outward relative to the inner casing by the amount of the groove depth (t). The axial end portions 19*a*, 19*b* of the groove 17 are in this case expediently formed by the slot walls 8*a*, 8*b*, the semicircular groove 17 passing into the tangentially touching slot groove 25. A partition can advantageously be inserted into the groove 17, which can be guided securely in the slot 3 down to the slot bottom 16. It is apparent from FIG. 4 that the outer sides 12*a*, 12*b* of the slot walls, due to the radially widened groove 17, jut out over the outer casing 13 of the collecting pipe 2. In this embodiment, the slot length (a) may be enlarged relative to the pipe inner diameter (d) by double the amount of the groove depth (t).

Figure 5:
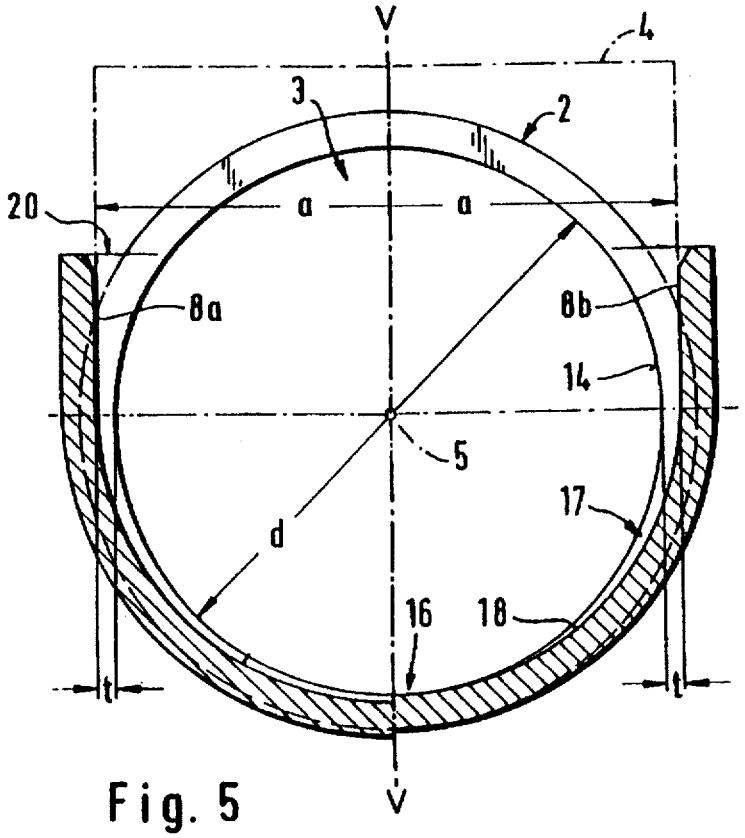
FIG. 5 illustrates a representation, comparable to FIG. 3, having a circumferential groove in a different embodiment.

Referring now to FIG. 5, the collecting pipe of this embodiment also has a radially widened groove 17 lying in the slot plane 4, the groove depth (t) between the groove bottom 18 and pipe inner casing 14 diminishing as the distance from the slot opening 20 to the slot bottom 16 increases. As is shown in the right half of the illustration in FIG. 5, i.e., the portion of FIG. 5 to the right of vertical axis V—V, the groove depth (t) can go right back to zero, i.e. the groove bottom 18 merges into the inner casing 14. In accordance with the embodiment shown in the left half of the illustration, i.e., the portion of FIG. 5 to the left of vertical axis V—V, the groove depth (t) on the slot bottom 16 can have a residual measure and need not go all the way to zero. The slot length (a) can be determined by the spacing between the slot walls 8*a*, 8*b*. The skilled artisan will appreciate that (i) the groove depth (t) may have a residual measure on both sides of vertical axis V—V; (ii) the groove depth (t) may go all the way to zero on both sides of vertical axis V—V; or (iii) on one side of vertical axis V—V, the groove depth (t) has a residual measure, whereas the groove depth (t) on the other side will go all the way to zero, as depicted in FIG. 5.

Figure 6:
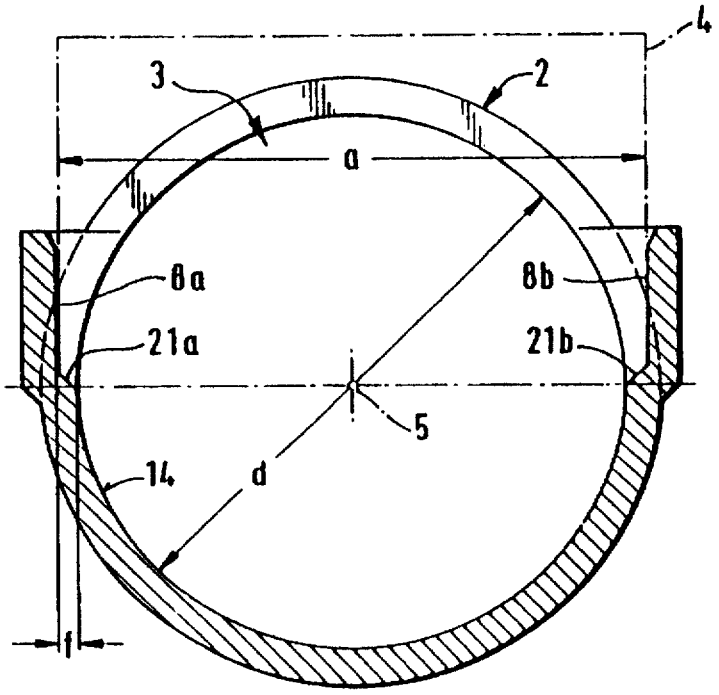
FIG. 6 illustrates a cross section through a collecting pipe having slot walls which are offset radially outward.

Referring now to FIG. 6 a further expedient configuration of the slot 3 in the collecting pipe 2 is shown. In this embodiment, the slot walls 8*a*, 8*b* are offset radially outward relative to the pipe inner casing 14 by an amount (f). A shoulder 21*a*, 21*b* is formed between the pipe inner casing 14 and the slot walls, which advantageously slopes obliquely downward as a ramp-shaped transition between the slot wall and the inner casing. As a result of the ramp-shaped configuration of the shoulder, material stresses which can be generated by the slot enlargement in the pipe wall of the collecting pipe are kept to a minimum. The flat pipe inserted into the slot 3 can be supported against the shoulder 21*a*, 21*b*, whereby a pre-fixed insertion depth is determined. Shoulder 21*a*, 21*b* additionally prevents liquid solder material, during the soldering operation, from flowing down between the slot walls 8*a*, 8*b* and the narrow sides of the flat pipe and entering into the interior of the collecting pipe 2. In this configuration, the slot length (a) usually is widened by double the mount of the offset (f) between the inner casing and the slot wall relative to the pipe inner diameter (d).

Figure 7:
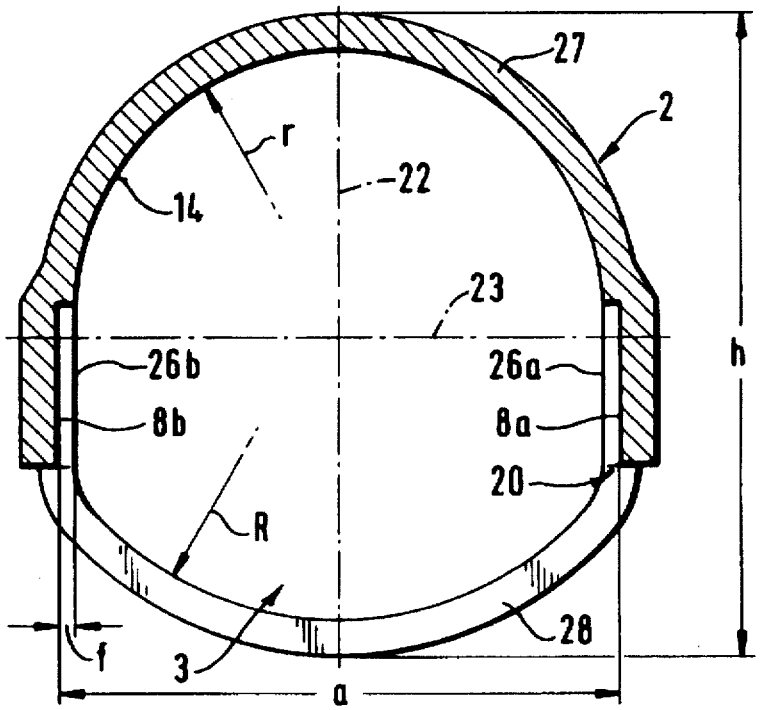
FIG. 7 illustrates a cross section through a collecting pipe having a cross-sectional shape which differs from the circular form.

Referring now to FIGS. 7 to 10, there are shown embodiments of the invention whereby a collecting pipe has a cross section other than a circular cross section. The cross section shown therein advantageously is configured symmetrically relative to a cross-sectional longitudinal axis 22, as can be seen in FIG. 7. The cross section illustrated in FIG. 7 can be composed of two circular segments 27, 28 of different radius (r), (R), which are joined together by two straight wall portions 26*a*, 26*b* aligned roughly parallel to the cross-sectional longitudinal axis 22.

The slot opening 20 can expediently be made on the circular segment 28 of larger radius (R), the slot walls 8*a*, 8*b* extending on the straight wall portions 26*a*, 26*b* and, in particular, being offset radially outward relative to the pipe inner casing 14 by an amount (f). The slot length (a) can therefore be widened relative to the inner width of the collecting pipe, measured along the transverse axis 23, by double the amount (f). The slot walls 8*a*, 8*b* usually extend to both sides of the transverse axis 23.

This configuration of the collecting pipe has the advantage that the structural height (h) of the collecting pipe 2 can be varied according to the length of the wall portions 26*a*, 26*b*. If the wall portions 26*a*, 26*b* are totally omitted, then the structural height (h), given the same cross-sectional surface area of the collecting pipe, is diminished in comparison to a pipe cross section which is round. The circular segment 28 of enlarged radius (R) makes bearing contact in the form of a gently rounded cover on both sides of the slot opening 20, whereby the structural height (h) is reduced.

Figure 8:
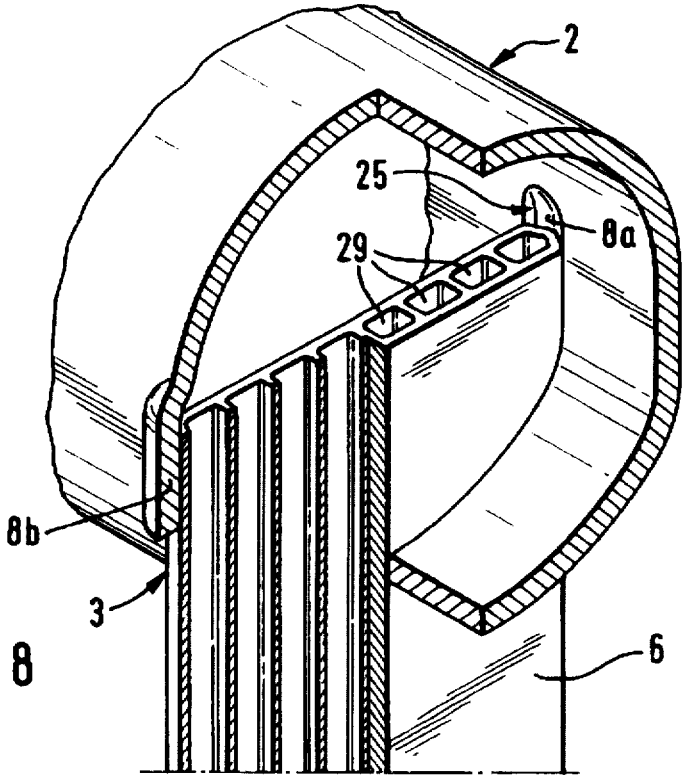
FIG. 8 illustrates a perspective representation of the collecting pipe according to FIG. 7, a flat pipe having been inserted therein.

The perspective representation of FIG. 8 illustrates a collecting pipe according to FIG. 7, with a flat pipe 6 inserted into the slot 3, which flat pipe is configured as a multi-chamber profile having a plurality of parallel individual ducts 29. The narrow sides of the flat pipe 6 are of gently rounded configuration and are guided in the slot grooves 25 of the slot walls 8*a*, 8*b*.

Figure 9:
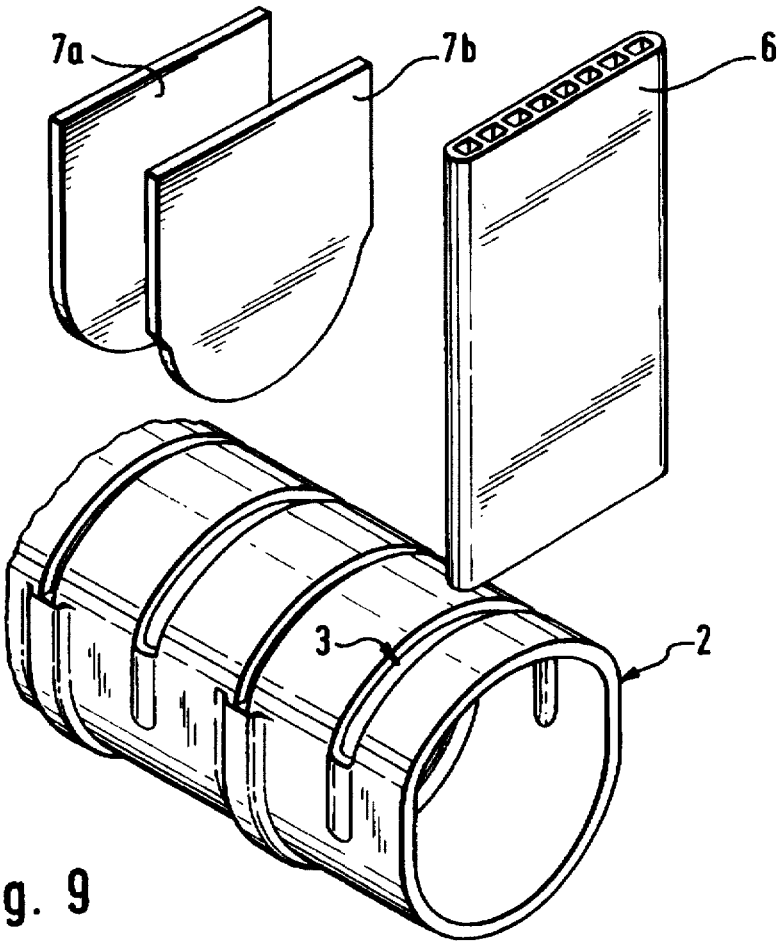
FIG. 9 illustrates a perspective representation of an axially larger portion of the collecting pipe according to FIG. 7.

FIG. 9 illustrates a further perspective representation of a collecting pipe 2 from FIG. 7, a larger axial portion of the collecting pipe being represented. In the collecting pipe shown in FIG. 9, there are a plurality of parallel, roughly equidistant slots 3, which, as previously described, have either slot walls which are offset radially outward or a groove which is radially widened. In addition to a flat pipe 6, there can be inserted into the slots partitions 7*a* and 7*b*, which have a contour matched to the interior of the pipe in the region of the slot.

The partition 7*a* can be configured, for example, as a plate, the thickness of which corresponds roughly to the slot width and which has a roughly rectangular shape with a semicircular end portion. The partition 7*a* can be inserted into a slot configured according to FIGS. 1, 3 or 5. The partition 7*b* likewise has a roughly rectangular shape, the end portion being configured as a circular segment of smaller diameter than the rectangular width. This produces, in the transition zone from the circular segment to the rectangle, a shoulder, which is of complementary configuration to the shoulder 21*a*, 21*b* of the slot according to FIG. 6 or FIG. 7, respectively.

The collecting pipe of FIG. 9 has the same non-circular cross-sectional shape over the whole of the portion shown; according to one embodiment (not represented), it can also be expedient to form only individual segments of the collecting pipe in the region of the slots in non-circular configuration and to make the other collecting pipe portions circular. In this case, the non-circular portions can be produced by shaping, and the like. Those skilled in the art can readily design and fabricate a collecting pipe in which portions in the region of the slots are non-circular and portions in the other regions of the collecting pipe are circular.

Figure 10:
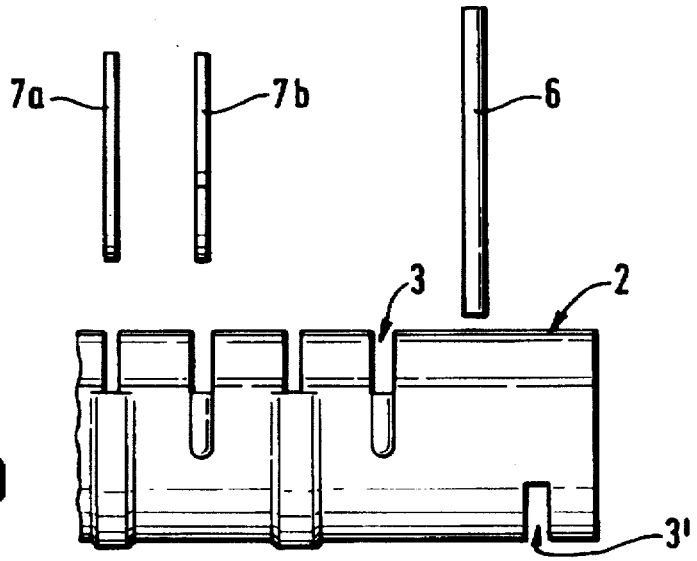
FIG. 10 illustrates a side view of the representation according to FIG. 9.

Referring now to FIG. 10, a side view of the representation according to FIG. 9 is illustrated whereby a further slot 3' is disposed on the collecting pipe 2, which can be located on the opposite side to a preceding slot 3. A reciprocal arrangement of the slots on opposite sides of the collecting pipe can be expedient, in particular where flat pipes are inserted into the slots on one collecting pipe side and partitions are inserted into the slots on the opposite side.

Figure 11C:
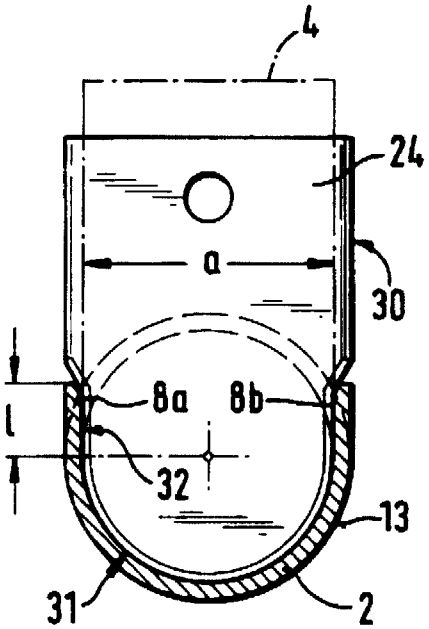
FIGS. 11*a*, *b* and *c* respectively illustrate a cross section through a collecting pipe during the various stages of the production process.
Figure 11B:
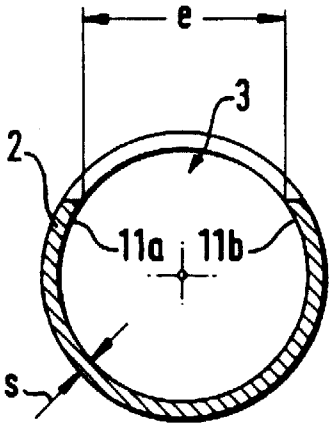
Figure 11A:
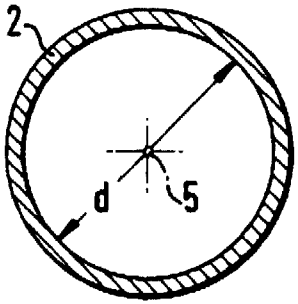

FIGS. 11*a*–11*c* illustrate portions of a process for creating a slot in a collecting pipe. FIG. 11*a* depicts a section through a non-deformed collecting pipe 2, in which, in FIG. 11*b*, a slot 3 is made by sawing, milling, punching or the like. The slot 3 which is made in a first step (FIG. 11*b*) has a smaller slot length (e) than the collecting pipe inner diameter (d), as shown in FIG. 11*a*. In the region of the slot, the collecting pipe therefore has a circular segment form which extends beyond a semicircular form. In a subsequent step, the collecting pipe walls 11*a*, 11*b* which limit the narrow sides of the slot 3 are enlarged and calibrated to the definitive slot length (a) by means of a slot punch 24, or the like, see FIG. 11*c*. The collecting pipe walls 11*a*, 11*b* thus can form the parallel-running slot walls 8*a*, 8*b*.

In accordance with further embodiments of the invention, there can be provided a slot having a length (e) made in the first step described above, whereby the length (e) is reduced relative to the collecting pipe inner diameter (d) by at least double the wall thickness (s) of the collecting pipe 2. This ensures that, when the collecting pipe walls are enlarged to the final measure, the front region of the slot walls 8*a*, 8*b* lies outside the outer casing 13 of the collecting pipe 2.

Using the slot punch 24, the slot walls 8*a*, 8*b* can be offset radially outward to such an extent that the slot length (a), determined by the spacing between the slot walls 8*a*, 8*b* is larger than the collecting pipe inner diameter (d), see FIGS. 6 and 7 in this regard. The slot punch 24 can be constructed for this purpose similarly to the above-described partition 7*b*, whereby it may comprise a roughly rectangular basic element 30, which is adjoined by a roughly semicircular end portion 31 matched to the pipe cross section. The end portion 31 advantageously has a smaller diameter than the rectangular basic element 30 of the slot punch 24, the diameter expediently being reduced by double the amount of the wall thickness (s).

As can be seen in FIG. 11*c*, between the basic element 30 and end portion 31 there can be inserted into the slot punch 24 an intermediate portion 32, which has roughly the length (L) of the slot walls 8*a*, 8*b* and has the same width as the diameter of the end portion 31.

Figure 12:
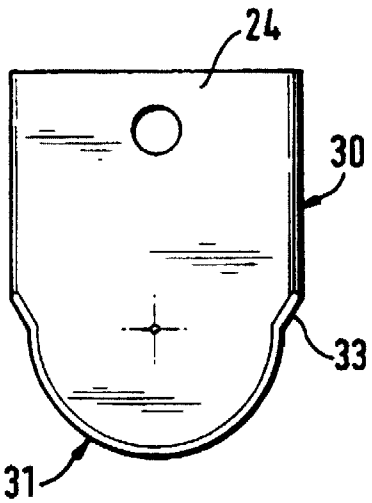
FIG. 12 illustrates a slot punch for widening the slot walls.

According to FIG. 12, the end portion 31 can also be adjoined to the basic element 30 directly via an oblique transition 33. Using a slot punch 24 of this type, the slot walls 8*a*, 8*b* of FIGS. 6 and 7, respectively, which slot walls are offset radially outward, can advantageously be produced, whereby the end portion 31 can have the same diameter as the collecting pipe inner diameter and can be fully sunk into the collecting pipe interior.

Should the end portion 31 of the slot punch 24 have a larger diameter than the collecting pipe inner diameter, a groove 17, which lies in the slot plane 4 and runs radially round the inner casing 14 of the collecting pipe, can be impressed, see, FIGS. 3 and 5.

The device or process according to the invention can expediently be used in all metal heat exchangers such as oil coolers, charge coolers, in heating elements and flat-pipe condensers, irrespective of whether these are of single-flow or multi-flow design.

The invention has been described in detail by reference to particularly preferred embodiments thereof. Those skilled in the art will appreciate that various modifications and changes can be made to the invention without departing significantly from the spirit and scope thereof.

What is claimed is:

1. A heat exchanger having a collecting pipe with an outer and an inner casing, said collecting pipe having an inner diameter (d), wherein said collecting pipe comprises at least one slot lying in a plane roughly perpendicular to a longitudinal axis of said collecting pipe, said slot being defined by narrow sides which are limited by parallel-running slot walls of the collecting pipe which extend roughly along a tangent to a circle around said pipe longitudinal axis, said slot walls being separated by a distance and said slot having a length, (a), determined by the distance between said slot walls, said length (a) being equal to at least the collecting pipe inner diameter (d), said slot walls being formed from deformed wall portions of said collecting pipe which have a constant wall thickness (s) over their wall length (L), and outer sides of the slot walls lie outside the outer casing of said collecting pipe, wherein said slot walls are offset radially outward relative to the pipe inner casing and a shoulder is formed between the slot walls and the pipe inner casing, and wherein said slot is capable of accepting either a flat pipe which can accommodate flowing fluid, or a partition.

2. The heat exchanger as claimed in claim 1, wherein said slot walls extend at least from one pipe center plane along a tangent with the pipe outer casing.

3. The heat exchanger as claimed in claim 1, wherein the collecting pipe has a cross section which differs from the circular form.

4. The heat exchanger as claimed in claim 3, wherein the collecting pipe has a cross section which is symmetrical relative to a cross-sectional longitudinal axis.

5. The heat exchanger as claimed in claim 3, wherein the cross section is formed from two circular segments having a different radius from one another, said circular segments being joined together by straight wall portions aligned roughly parallel to a cross-sectional longitudinal axis.

6. The heat exchanger as claimed in claim 5, wherein the slot opening is provided on the circular segment having the larger radius and the slot walls extend on the straight wall portions.

7. The heat exchanger as claimed in claim 1, wherein two axially successive slots are disposed on opposite sides of the collecting pipe.

* * * * *